United States Patent [19]

Lee

[11] 4,000,604

[45] Jan. 4, 1977

[54] TEXTURIZED ACETATE YARN AND METHOD OF MANUFACTURE

[76] Inventor: Sung In Lee, 256-30, Seonsan, Seodaemoon, Seoul, South Korea

[22] Filed: Mar. 19, 1974

[21] Appl. No.: 452,705

[52] U.S. Cl. ..... 57/153; 57/164

[51] Int. Cl.[2] ..... D02G 3/02; D02G 3/36

[58] Field of Search ..... 57/6, 7, 144, 149, 153, 57/156, 162, 164

[56] References Cited

UNITED STATES PATENTS

| | | | |
|---|---|---|---|
| 2,220,958 | 11/1940 | Jennings | 57/153 X |
| 2,669,766 | 2/1954 | Beard | 57/153 X |
| 2,807,864 | 10/1957 | Head | 57/153 |
| 3,381,465 | 5/1968 | Kingsbery et al. | 57/153 X |
| 3,425,208 | 2/1969 | Shippee et al. | 57/153 X |
| 3,458,989 | 8/1969 | Obrien et al. | 57/153 |

*Primary Examiner*—Donald E. Watkins
*Attorney, Agent, or Firm*—Garo A. Partoyan; Donald P. Gillette

[57] ABSTRACT

A process for making bulky elastic texturized acetate yarn having good elasticity, good tensile strength and good durability of elasticity and tensile strength in washing and dry cleaning which comprises applying to acetate yarn a curable synthetic resin, applying to said acetate yarn a twist wet heat setting agent, bulking and texturizing said acetate yarn by imparting a false twist thereto, heating said yarn to twist wet heat set said false twist, dissolve twisting said yarn, drying said acetate yarn and heat treating said dried acetate yarn to cure said curable synthetic resin therein, and bulky elastic texturized acetate yarn so made.

8 Claims, 2 Drawing Figures

Figure 1:
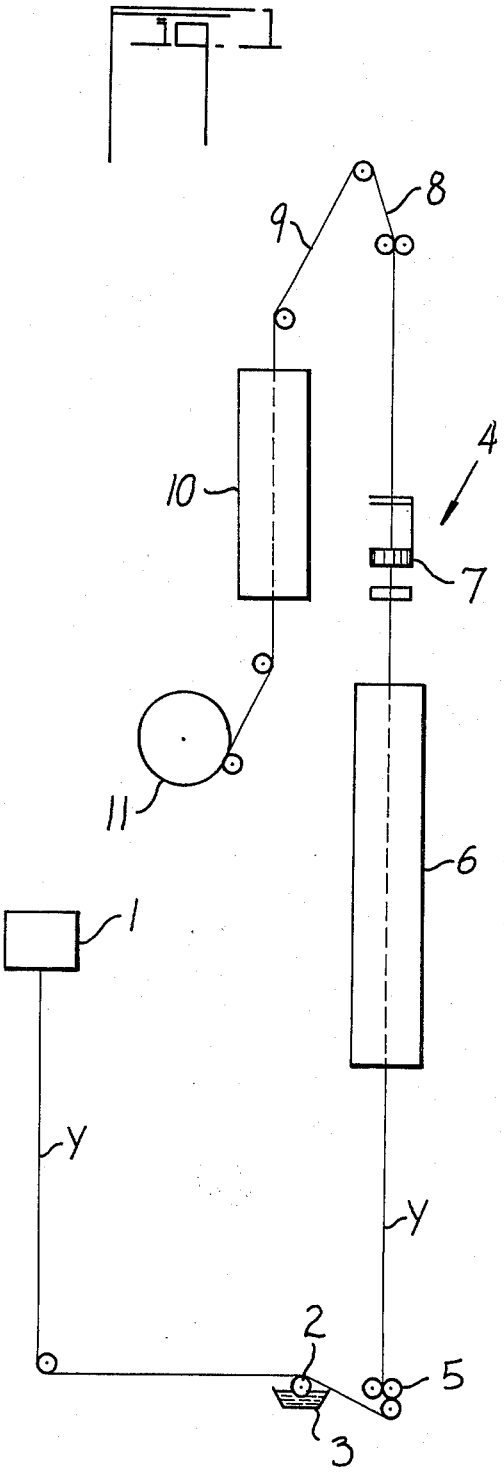

9
8
10
4
7
11
6
1
Y
Y
2
5
3

9'
8'
11'
4'
7'
6'
1'
Y
2'
3'
Y
12
2"
3"
5'

TEXTURIZED ACETATE YARN AND METHOD OF MANUFACTURE

This invention relates to bulky, elastic texturized acetate yarn and to a process for the production of such yarn.

Methods for attempting to make texturized acetate yarn are typically considered as either twist dry heat setting or twist wet heat setting, and in general have not produced texturized acetate yarn having many desirable characteristics. For example, bulky texturized acetate yarn produced by typical dry heat setting method usually has good elasticity but has very weak tensile strength and in water loses its elasticity. Bulky texturized acetate yarn produced by typical wet heat setting method, on the other hand, usually tends to retain its elasticity in water but has both poor elasticity and very weak tensile strength. Thus bulky, elastic texturized acetate yarn heretofore known and produced by typical dry heat setting and wet heat setting procedures has not been as satisfactory and useful as texturized yarns produced by corresponding methods from yarns of other synthetic filaments such as polyester and nylon.

Accordingly, it is an object of this invention to provide a useful bulky, elastic texturized acetate yarn. It is also an object of this invention to provide such a yarn that has both good elasticity and good tensile strength. A further object of the invention is to provide a texturized acetate yarn that has good durability of elasticity during both washing and dry cleaning. Another object of this invention is to provide a texturized acetate yarn that has increased elasticity and increased tensile strength. Still another object of this invention is to provide procedures for making bulky, elastic texturized acetate yarn having the characteristics mentioned.

It has now been discovered that bulky, elastic texturized acetate yarn having increased elasticity and increased tensile strength as well as good durability of elasticity during both washing and dry cleaning can be prepared by application of curable synthetic resin to the filaments of the yarn and thereafter heat setting the yarn in connection with bulking and texturizing the yarn by twist wet heat setting. The synthetic resin can be applied to the filaments of the yarn in admixture with a twist wet heat setting agent, after which the yarn is twisted and wet heat set and then dissolve twisted, dried and further heat treated to cure the resin. Alternatively, the curable synthetic resin can be applied to the filaments of the yarn, dried and heat cured, followed by application of the twist wet heat setting agent to the yarn, which is then bulked and texturized by twist wet heat setting and thereafter dissolve twisted. By these procedures of dry heat setting or curing of the synthetic resin in the acetate yarn filaments in connection with bulking and texturizing twist wet heat setting and subsequent dissolve twisting, it is possible to produce a bulky, elastic texturized acetate yarn having fully useful properties characteristic of both acetate fibers and other general purpose texturized yarns, such as durable good elasticity and tensile strength as heretofore mentioned.

Figure 2:
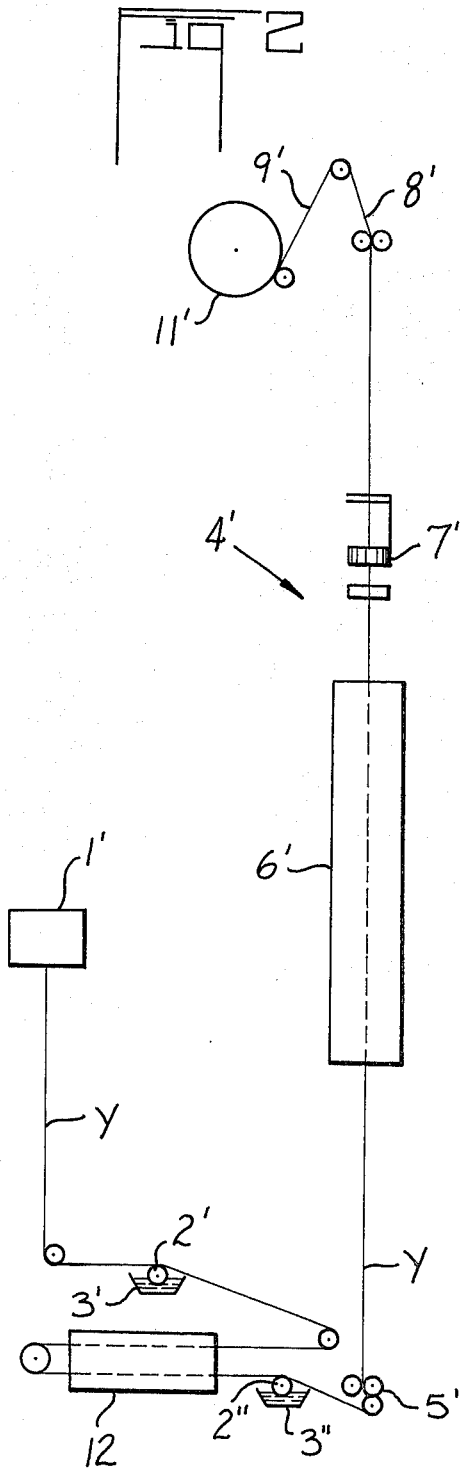

Understanding of the techniques and apparatus involved with the instant invention can be assisted by reference to the accompanying drawings wherein:

FIG. 1 is a schematic and illustrates the procedure by which the acetate yarn is treated with an admixture of curable synthetic resin and twist wet heat setting agent, twisted and wet heat set, dissolve twisted, and heat treated to cure the resin; and FIG. 2 is a schematic and illustrates the procedure by which the acetate yarn is treated with curable synthetic resin, dried and heat treated to cure the resin, followed by application of the twist wet heat setting agent, texturizing twist and twist wet heat setting.

From FIG. 1 it can be seen that the process is initiated by drawing acetate yarn Y from bobbin 1 and over the roll 2 of an applicator 3 containing an admixture of texturizing twist wet heat setting agent and curable synthetic resin, for example, coning oil and an acrylic resin emulsion, which wets and penetrates the acetate filaments of the yarn. The yarn Y then enters into a bulking and texturizing false twist device 4, passing through a feed roll assembly 5, a heater section 6 and a false twist spindle and offset guide device 7, and then to a package feed roll assembly 8. The yarn then passes through a dissolve twist section 9 to a further heat treatment section 10 and onto a package holder takeup device 11 for winding.

The temperature in the heater section 6 is in the range of about 120° C. to about 195° C. depending mainly upon the speed of yarn Y passing through and the size, e.g., denier, of the yarn filaments. A preferred temperature range, especially when coning oil is used as the twist wet heat setting agent, is about 160° C. to about 180° C. Because the yarn is wet with the agent and not fully dried in the heater section 6, curable synthetic resin is not cured during the course of twist setting. The yarn is completely dried subsequently in the heat treatment section 10 in which the synthetic resin is cured. The temperature in the heat treatment section 10 is about 100° C. to about 145° C., preferably about 130° C. to about 135° C., e.g., when an acrylic resin emulsion is used.

In the process depicted in FIG. 2, yarn Y is taken from a bobbin 1' and passed over the roll 2' of an applicator 3' that applies curable synthetic resin to the yarn. The yarn then passes through a heat setting oven 12 that dries the yarn and cures the resin. The temperature of the heat setting oven 12 is about 100° C. to about 145° C., preferably about 130°–135° C., for example, when an acrylic emulsion resin is used. After this treatment, the yarn Y passes over a roller 2'' of another applicator 3'' that applies the twist wet heat setting agent. From there the yarn Y enters a bulking and texturizing false twist device 4', passing through a feed roll assembly 5', a heater section 6' and a false twist spindle and offset guide device 7', and then to a package feed roll assembly 8'. The bulked and texturized yarn then passes through a dissolve twist section 9' and is wound up in a package holder device 11'. The temperature in the heater section 6' is in the range of about 120° to about 195° C., depending upon the speed and size of the yarn Y passing through. With coning oil, a preferred range is about 160°–180° C.

A variety of curable synthetic resins can be used according to the present invention. Such resins include melamines, ureas, ethylene vinyl acetates, vinyl acetates and acrylics. The resin desirably should be of the self-crosslinking type, and preferably should be capable of interlinking with the acetate filaments of the yarn. Suitable resins typically are commercially available in solution, dispersion and emulsion form, which can be diluted for application to the yarn. A particularly suitable curable synthetic resin is the acrylic emulsion available from Rohm and Haas Company under the trade designation Rhoplex TR-653.

The amount of curable synthetic resin cured with the yarn filaments can vary greatly depending on numerous factors. In general, at least in the order of about 0.05 percent of resin based on the weight of yarn should be used so that elasticity and tensile strength can be enhanced. At the other extreme, it appears that about 10 percent of resin is a practical limit because of the adverse effects such an amount begins to have on the desirable properties of the acetate yarn. A better working range of resin amount is about 0.1 percent to about 5 percent based on the weight of yarn. For Rhoplex RT-653 acrylic emulsion for example, an amount of about 0.5 percent to about 2 percent gives very good results while not impairing the softness or absorbing power of the acetate yarn.

As twist wet heat setting agent for use according to this invention there has been found to be especially suitable coning oil. Coning oil is available from Matsumoto Yushi-Seiyaku Co., Ltd., of Osaka, Japan under the trade designations Brian C-330, Brian C-330K and Brian C-1010. Brian C-330K is preferred because its rates of evaporation at about 150° C. and about 180° C. are such that it enables the twist wet heat setting to be done at a temperature of about 160° to 180° C., which approaches the melting point of the acetate filaments.

It will be appreciated from the foregoing description of the invention that numerous changes can be made in the various factors disclosed, such as the ingredients and conditions, without departing from the scope of the invention or of the claims hereafter appended.

I claim:

1. A process for making bulky elastic texturized acetate yarn having good elasticity, good tensile strength and good durability of elasticity and tensile strength in washing and dry cleaning which comprises applying to acetate yarn a curable synthetic resin, applying to said acetate yarn coning oil as a twist wet heat setting agent, bulking and texturizing said acetate yarn by imparting a false twist thereto, heating said yarn to twist wet heat set said false twist, dissolve twisting said yarn, drying said acetate yarn and heat treating said dried acetate yarn to cure said curable synthetic resin therein.

2. A process according to claim 1 wherein said curable synthetic resin and said twist wet heat setting agent are simultaneously applied from an admixture thereof, said false twist is twist wet heat set in said yarn, and thereafter said yarn is dried and said resin is cured.

3. A process according to claim 1 wherein said curable synthetic resin is applied to said acetate yarn, said yarn is dried and said resin is cured, and thereafter said twist wet heat setting agent is applied, said false twist is imparted and wet heat set, and said yarn is dissolve twisted.

4. A process according to claim 1 wherein said false twist is twist wet heat set in said yarn at a temperature of about 120° C. to about 195° C., and said resin is cured at a temperature of about 100° C. to about 145° C.

5. A process according to claim 1 wherein said curable synthetic resin is from the group of melamine, urea, ethylene vinyl acetate, vinyl acetate and acrylic resin capable of self crosslinking.

6. A process according to claim 1 wherein said curable synthetic resin is an acrylic resin emulsion that is cured at about 130° to 135° C., and said false twist is twist wet heat set at a temperature of about 160° to 180° C.

7. A bulky elastic texturized acetate yarn having good elasticity, good tensile strength and good durability of elasticity and tensile strength in wasing washing dry cleaning which comprises a yarn composed of acetate filaments, said filaments being in substantially twisted orientation along their length whereby said filaments have different surface textures along their lengths formed by bends, loops, folds, spirals and the like deorientations about the longitudinal axis of said filaments, said twisted orientation of said filaments being an imparted and set false twist, said false twist being imparted and set by wet heat set in the presence of coning oil twist wet heat set agent, and a cured crosslinked synthetic resin integral with said filaments, said cured crosslinked synthetic resin being from the group of a melamine, urea, ethylene vinyl acetate, vinyl acetate and acrylic resin.

8. A bulky elastic texturized acetate yarn according to claim 7 wherein said cured crosslinked synthetic resin is an acrylic resin.

* * * * *